US007278777B2

(12) United States Patent
Elsten

(10) Patent No.: US 7,278,777 B2
(45) Date of Patent: Oct. 9, 2007

(54) HAND HELD CONCRETE VIBRATOR

(76) Inventor: Stanley E. Elsten, 7741 Eldon Rd., Riverton, KS (US) 66770

( * ) Notice: Subject to any disclaimer, the term of this patent is extended or adjusted under 35 U.S.C. 154(b) by 444 days.

(21) Appl. No.: 10/864,953

(22) Filed: Jun. 10, 2004

(65) Prior Publication Data

US 2005/0276156 A1 Dec. 15, 2005

(51) Int. Cl.
*B01F 11/00* (2006.01)

(52) U.S. Cl. ..... 366/108; 366/117

(58) Field of Classification Search ..... 366/117, 366/108; 601/51, 56, 58, 46, 97, 107; 15/22.2; 74/56

See application file for complete search history.

(56) References Cited

U.S. PATENT DOCUMENTS

| | | | | | |
|---|---|---|---|---|---|
| 1,215,439 | A | * | 2/1917 | Wagner | 74/56 |
| 1,352,894 | A | * | 9/1920 | Hoffine | 74/56 |
| 1,588,832 | A | * | 6/1926 | Young | 74/56 |
| 1,751,087 | A | | 3/1930 | Jackson | |
| 2,290,454 | A | * | 7/1942 | Steinberg | 15/22.2 |
| 2,313,110 | A | | 3/1943 | Wertz | |
| 2,556,163 | A | * | 6/1951 | Beeson et al. | 173/109 |
| 2,799,035 | A | * | 7/1957 | Pfluger | 15/22.1 |
| 3,066,350 | A | | 12/1962 | Quiring | |
| 3,149,681 | A | * | 9/1964 | Drew | 173/97 |
| 3,782,693 | A | | 1/1974 | Strohbeck | |
| 3,807,242 | A | * | 4/1974 | Stone | 74/56 |
| 3,866,480 | A | | 2/1975 | Elliston | |
| 4,073,593 | A | | 2/1978 | Storm | |
| 4,102,334 | A | * | 7/1978 | Muchisky | 601/73 |
| 4,901,588 | A | * | 2/1990 | Zudal | 74/57 |
| 4,908,909 | A | | 3/1990 | Akrenius | |
| 5,224,231 | A | * | 7/1993 | Nacar | 15/22.2 |
| 5,725,304 | A | | 3/1998 | Inai | |
| 6,325,531 | B1 | | 12/2001 | Lindley | |
| 6,543,926 | B2 | | 4/2003 | Sherez | |
| 7,066,042 | B2 | * | 6/2006 | Andrews et al. | 74/110 |

* cited by examiner

*Primary Examiner*—Tony G. Soohoo
(74) *Attorney, Agent, or Firm*—Marcia J. Rodgers; Dennis A. Crawford; Shughart Thomson & Kilroy PC

(57) ABSTRACT

A concrete vibrator powered by a portable drill includes a housing having a contacting pad at one end and an axial bore. A camshaft is received within the bore. A transverse retainer is secured on the camshaft for retaining the camshaft within the bore. The camshaft includes a pair of cam surfaces at one end. A cam follower is disposed within the bore for engaging the cam surfaces when the camshaft is rotated. The cam follower and cam surfaces cooperatively cause axial reciprocation of the rotating camshaft for producing axial vibration of the housing face. The axial bore includes a radially expanded portion to receive the retainer and prevent complete withdrawal of the camshaft. The camshaft includes a transverse bore for receiving the retainer within the radially expanded portion. The retainer has a spring bearing against a trapped ball projecting beyond the cylindrical surface of the camshaft.

17 Claims, 4 Drawing Sheets

HAND HELD CONCRETE VIBRATOR

BACKGROUND OF THE INVENTION

The present invention is broadly concerned with a concrete vibrator apparatus. More particularly, it is concerned with a portable, hand held vibrator for use in conjunction with insulated concrete forms.

Modern building techniques for construction of concrete walls in commercial and residential structures frequently employ insulated concrete forms (ICF). These forms are constructed of a plastic foam material such as expanded polystyrene, extruded polystyrene, polyurethane or cement-foam composites. The foams are inert, nonabsorbent, are superior insulators, having extremely high R-values per inch, and are good barriers against air and moisture. The foams are also lightweight and easy to form or cut into blocks and panels.

Foam block units are generally of interlocking construction, which may be stacked into spaced-apart, open top walls which may be joined together using appropriate ties to produce hollow forms. Panel and plank units are stacked atop each other in parallel relation to form spaced-apart, open-top walls which may also be joined together using appropriate ties to produce similar hollow forms. Once constructed, the forms may be braced with wood and/or metal bracing members, and reinforcing rods placed therein. Concrete slurry is poured or pumped into the central cavity and permitted to cure, generally for about 48 hours. When the bracing is removed, the forms remain in place and are covered by interior and exterior finishing materials such as drywall, plaster, stucco, siding, brick or stone. This method of construction is increasingly popular because the finished structure is strong, durable, quiet, air tight and well insulated. Such structures are unusually energy efficient because the composite walls produce superior insulation qualities with reduced air infiltration.

Clearly, the integrity of a structure consisting of a layer of concrete sandwiched between layers of an insulating foam skin is dependent on the homogeneity of the concrete core. Air pockets and bubbles can negatively affect all of the beneficial qualities of the concrete and, if they are sufficiently large in size, can compromise its structural integrity as well.

Traditional concrete construction employs metal and/or wooden forms and such voids are commonly eliminated from wet concrete using a vibrator before the mix cures. In order to accomplish this, a worker often stands atop the form; inserts an elongated vibrator into the wet concrete between the rebar reinforcement rods and moves the vibrator up and down in the concrete between the forms to urge bubbles to the open surface. Such methods are generally not applicable to ICF construction because of the relative fragility of the plastic foam. Because the conventional vibrator must be elongated for reaching to the bottom of the wall structure, it is not easily controlled and may bump against the walls of the form. While wooden or metal form walls can withstand such rough handling, the more fragile foam forms may be punctured or displaced by vibrator contact. Foam forms are also subject to "blow outs" if subject to excessive bumping or rough handling, which might occur if a worker attempted to insert a vibrator shaft into the form from an adjacent scaffolding or ladder.

Wall contacting vibrators are known in the prior art. However, they are generally too heavy or cumbersome for hand held use, require physical attachment at locations along the form and/or are likely to damage foam forms.

Thus, there is a need for a concrete vibratory device having structure for contacting a foam wall and transmitting vibratory contact force; that can be moved along the exterior surface to remotely compact the concrete inside the form without form damage, and that is portable, light weight and hand held so that it can easily be controlled by a user.

SUMMARY OF THE INVENTION

The present invention provides a greatly improved, hand-held concrete vibrator which may be powered by a low-cost portable drill to compact concrete in an insulated concrete form (ICF) system. The assembly is portable, lightweight, simple in construction, and easily controlled for sweeping movement over the exterior surface of the form to work bubbles upwardly toward the open form top. The vibrator delivers an axial vibrating motion against the form that is distributed over a large surface so that it does not cause damage to the foam.

The vibrator includes a housing of a suitable, low friction but rigid material such as a synthetic resin material having a face at one end and an axial bore. A camshaft is received within the bore. A transverse retainer is secured on the camshaft for retaining the camshaft within the axial bore while allowing axial displacement therebetween. The camshaft at one end is shaped to form a pair of cam surfaces. A cam follower is disposed off center within the bore for engaging the cam surfaces when the camshaft is rotated. The cam follower and cam surfaces cooperate to cause axial reciprocation of the rotating camshaft within the bore, for producing axial vibration of the housing face. The axial bore includes a radially expanded portion to receive the retainer and thereby prevent the camshaft from being completely withdrawn from the housing but permitting easy relative axial movement therebetween. The camshaft includes a transverse, threaded bore for receiving the retainer within the radially expanded portion. The retainer has a hollow, generally cylindrical interior containing a spring bearing against a trapped ball projecting beyond the cylindrical surface of the camshaft.

Other objects and advantages of this invention will become apparent from the following description taken in conjunction with the accompanying drawings wherein are set forth, by way of illustration and example, certain embodiments of this invention.

The drawings constitute a part of this specification and include an exemplary embodiment of the present invention, and illustrating various objects and features thereof.

DETAILED DESCRIPTION OF THE INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
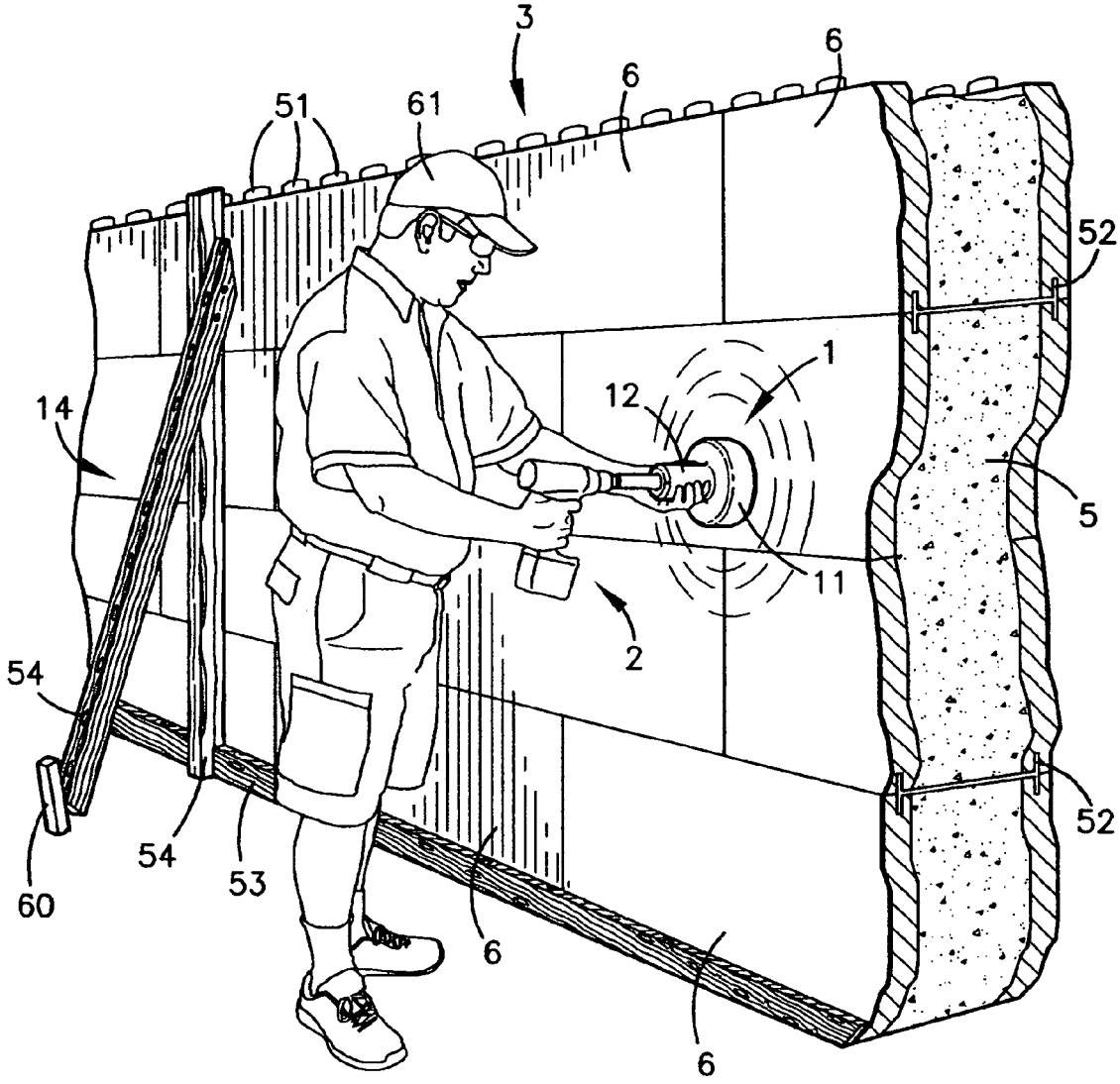
FIG. 1 is a perspective view of a hand held concrete vibrator in accordance with the present invention, shown in use in conjunction with a portable hand held power drill for external vibration of a concrete mix contained within an insulated wall form.
Figure 2:
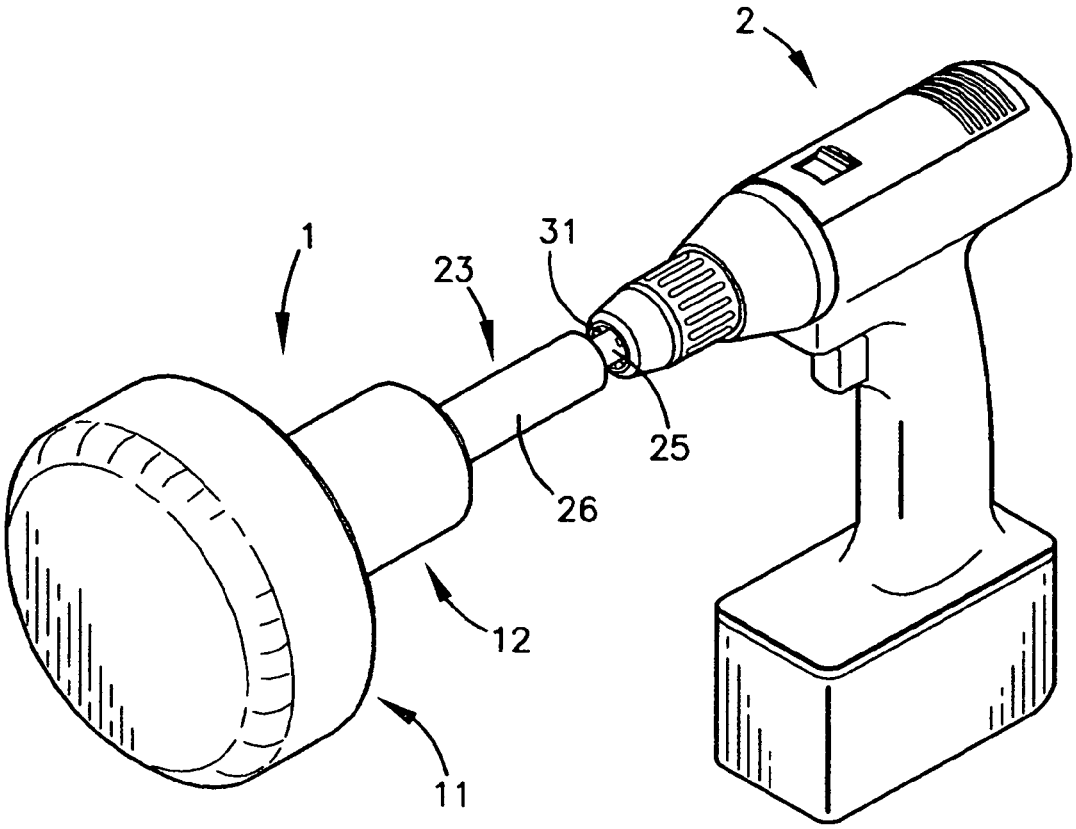
FIG. 2 is a perspective e view of the vibrator shown installed on a hand held portable drill.
Figure 3:
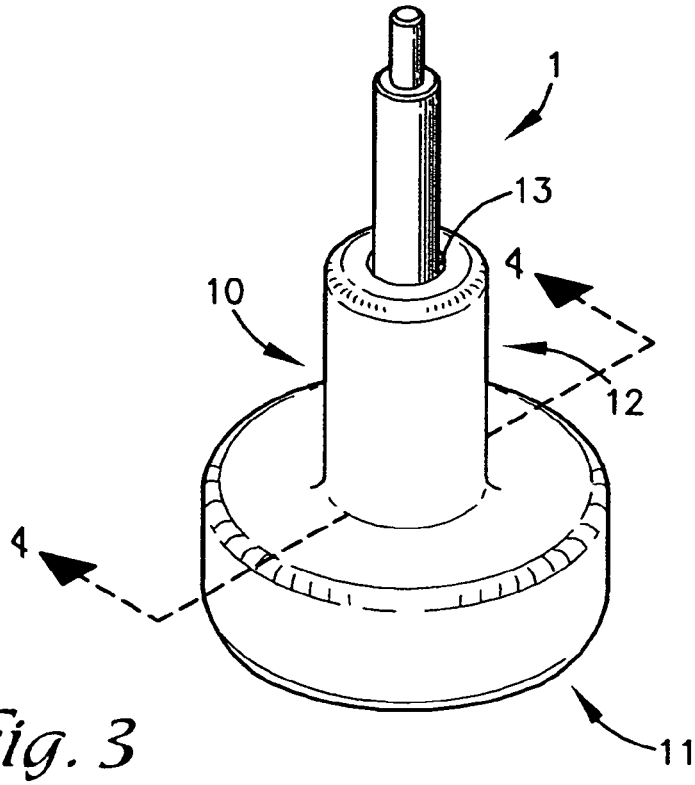
FIG. 3 is a perspective view of the concrete vibrator of FIG. 1.

Referring now to the drawing figures, the reference numeral 1 refers to a hand held concrete vibrator 1 in accordance with the invention, which is depicted in FIGS. 1 and 2 in association with a portable hand held drill 2 which is connected to the vibrator 1 for use in vibrating an insulated concrete wall form (ICF) 3 stabilized with bracing 4 and filled with a concrete mix 5 (FIG. 1).

As best shown in FIGS. 3-7, the concrete vibrator 1 includes a housing 10 having a vibration head or pad 11 at the free end, a hand piece or handle portion 12 at the inboard end and an axial bore 13. The vibration pad 11 is generally cylindrical in shape, and includes a front surface or face 14, rear surface 15 and circumferential sidewall 16. The elongated handle 12 is axially aligned with the pad 11 and is also generally cylindrical in shape and includes a rear surface 21 and circumferential sidewall 22. The diameter of the hand piece 12 is substantially less than the diameter of the pad 11 to enable comfortable circumferential gripping by a hand as shown in FIG. 1. The bore 13 is blind, extending axially from a countersunk entrance at the rear surface 21 of the handle 12 to the area of the junction of the handle 12 and the pad 11.

The housing 10 is of unitary construction from a synthetic resinous polymer material such as low or high density polyethylene, ultra high molecular weight polyethylene, a fluoropolymer, polypropylene, a metal such as aluminum or titanium or any other durable, fracture and abrasion resistant, lightweight material able to withstand rough handling. As shown in FIGS. 1-4, all of the edges of the housing 10 are rounded over for strength and to eliminate any edges that might catch on surface irregularities in the foam form 3 and impair the smooth movement of the apparatus 1 over the surfaces of the form 3.

An elongate, generally cylindrical drive or camshaft 23 is received within the bore 13 (FIGS. 4-7). One end of the camshaft 23 is shaped or rounded to form a cam surface 24 and the opposite end includes a stub shaft 25 having a reduced diameter for reception in a drill chuck 31 (FIG. 2). A center portion or shank 26 extends between the ends. A cam follower 32 (FIGS. 4-7) is disposed within the axial bore 13, and is positioned off center, adjacent the sidewall of the bore 13. The cam follower 32 includes a cylindrical body portion 33, with a curved head or top 34. It is also foreseen that the axial bore 13 may include an apertured bearing plate for supporting the cam follower 32. In such embodiments the cam follower 32 is threaded for registry with the bearing plate apertures and to permit adjustment of the depth of the cam follower 32 within the axial bore 13 by rotating advancement of the follower 32 within the apertures.

The camshaft 23 and cam follower 32 are constructed of 440-C stainless steel or which is hardened by heat treating to a Rockwell hardness number of 62 for a working wear life of tens of millions of oscillations. It is foreseen that other anti-galling metal materials may also be employed. The follower head 34 preferably has a radius of about 3/16 inch. The cam surface 24 preferably includes a pair of bevels, each subtending an angle of about 45° and resulting in a profile in which the cam surfaces subtend an angle of about 90° with respect to each other. The apex or cam center 27 is curved to form a radius of about 3/16 inches, corresponding with the radius of the follower head 33.

Figure 4:
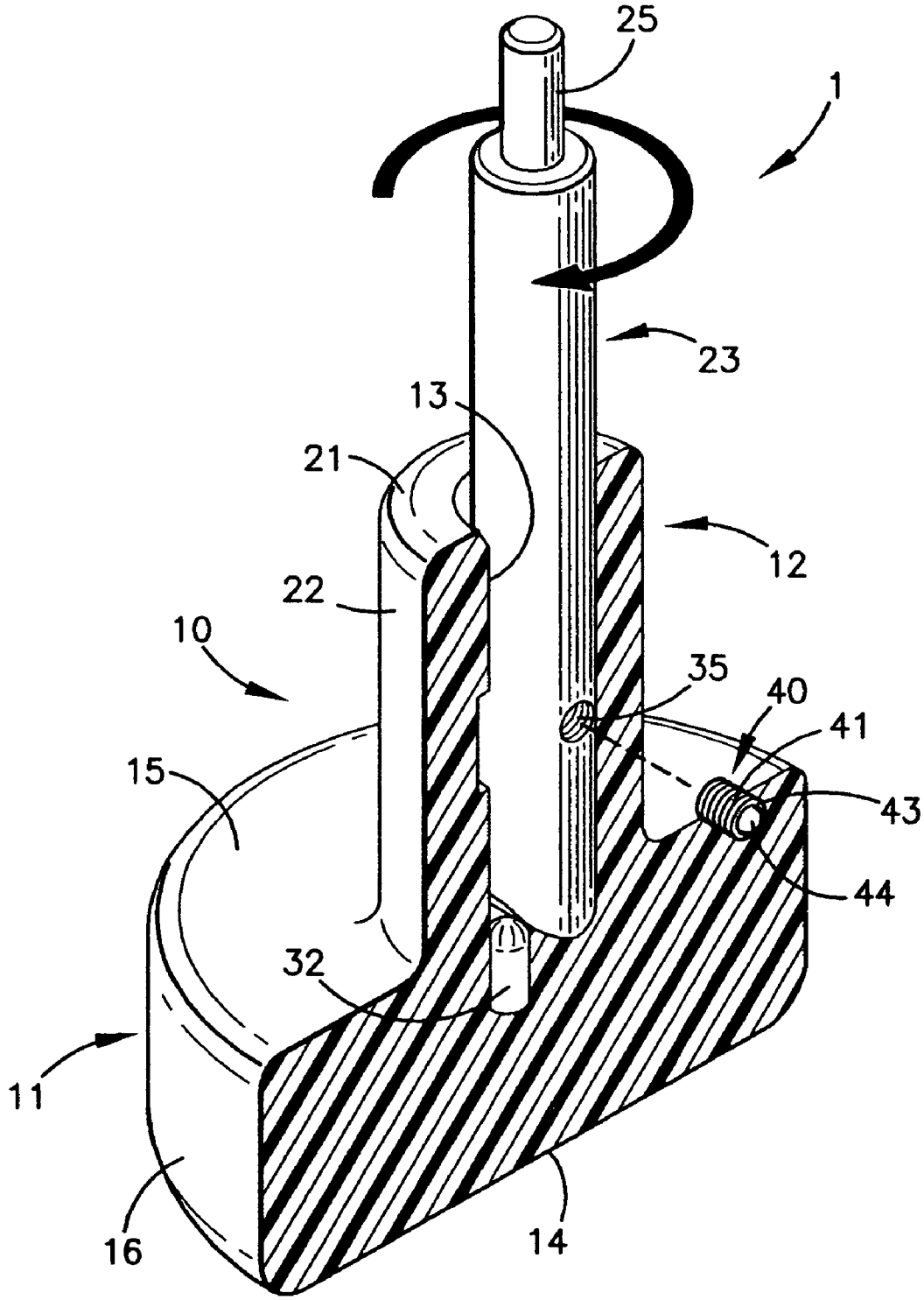
FIG. 4 is an enlarged sectional view of the housing taken along line 4-4 of FIG. 3 showing the shaft and cam follower with the retainer removed.

A transverse threaded bore 35 extends through the shank 26 of the camshaft 23 for receiving a threaded retainer assembly 40 (FIG. 4). The retainer 40 is of the ball detent or plunger type and includes a hollow, generally cylindrical housing 41 having an outwardly open end 42 terminating in a crimp or stop 43 which serves to reduce the diameter of the open end 42. The crimp 43 traps a ball 44, which is biased outwardly by a coil spring 45. The base wall of the housing 41 is equipped with a slot 50 (FIG. 5) to enable insertion and advancement of the retainer assembly 40 through the threaded bore 35 as well as selective adjustment of the retainer 40 until the ball 44 protrudes outwardly about 0.11 inches.

The axial bore 13 includes a radially expanded bore portion 36 for receiving the retainer 40 and enabling free rotation of the protruding ball 44 as the shaft 23 is axially rotated. The radially expanded bore 36 also serves as a lubrication chamber and may be charged with a quantity of a heat resistant lubricant composition such as lithium grease.

As best shown in FIG. 1, the vibrator apparatus is used in association with insulated concrete forms 3, which include a series of generally rectangular foam insulation block units, panels or planks 6 having a series of spaced projections 51 along the top edge for mating engagement with corresponding spaced depressions (not shown) along the bottom edge of each form block, panel or plank 6. The blocks, panels or planks 6 are placed atop prepoured footings or piers and are positioned and held in parallel relation by a series of generally H-shaped synthetic resin ties 52.

The bracing system 4 provides lateral support to the form 3 at intervals with a series of horizontal supports 53 and vertical masts 54. Transverse bracing members 55 are attached to the supports 53 and/or masts 54 and are held in place on the ground by pegs 60 or other ground engaging means. While wooden bracing is depicted in FIG. 1, it is foreseen that the braces may also be of metal construction, such as C-channel stock. The horizontal, vertical and transverse members 53, 54 and 55 are intercoupled with each other by means of fasteners such as nails, screws or turnbuckles, and the masts 54 may also be fastened to the ties 52. Steel reinforcing bar members (not shown) are installed within the cavity in the form 3, and the form is filled with a concrete mixture 5. The number and size of air bubbles present in the form at the conclusion of the pour will vary depending upon the size of the aggregate and the slump, with a 6 inch slump being generally preferred.

In use, the vibrator apparatus 1 is installed on a portable hand drill 2 in the manner shown in FIG. 2 by installing the stub shaft 25 into the drill chuck 31 and tightening the chuck 31. An exemplary drill is a ½ inch portable battery operated hand drill manufactured under the trademark Dewalt®, although any other chucking drill motor may be employed. On high drive, such a drill will deliver about 1800 revolutions per minute (rpm). A user actuates the drill, which drives the camshaft 23, causing it to rotate axially within the bore 13 through a motion cycle in which the cam 23 rides in and out over the fixed follower 32. It is foreseen that other means for rotating the shaft 23, such as a motor may be substituted for the portable hand drill 2 and that the motor means and vibrator 1 may be of unitary construction or in a single unit.

Figure 5:
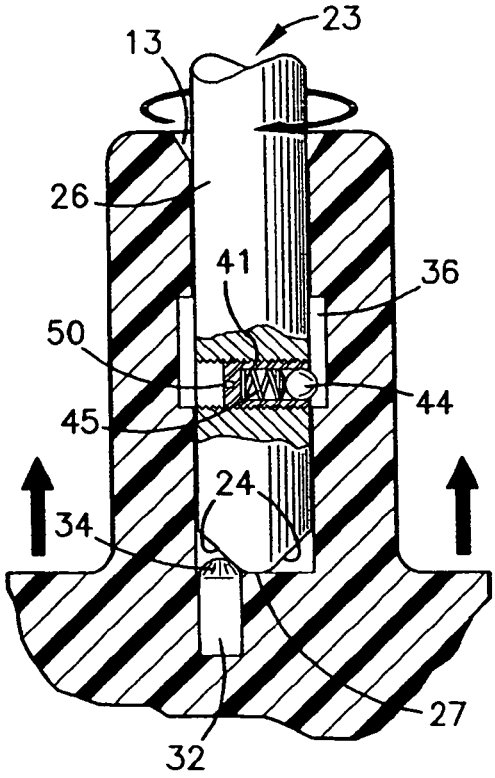
FIG. 5 is view similar to that shown in FIG. 4 with a sectional view of the retainer and its bore.
Figure 6:
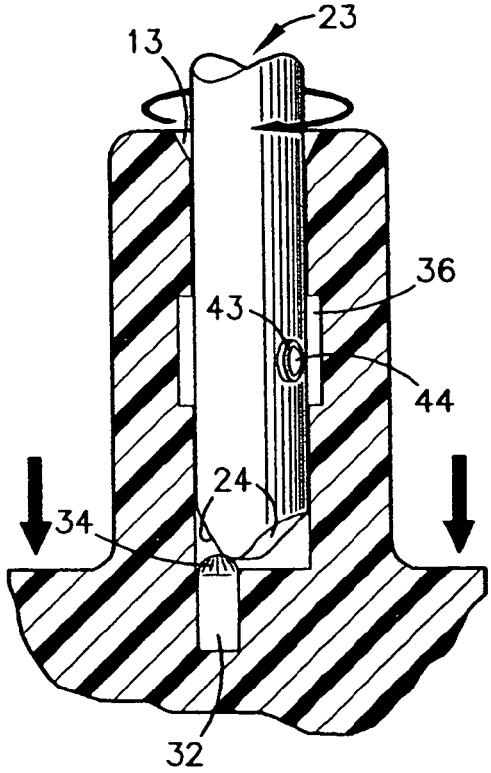
FIG. 6 is a view similar to that shown in FIG. 5, with the shaft rotated about 45 degrees and commencing to ride up on the cam follower.
Figure 7:
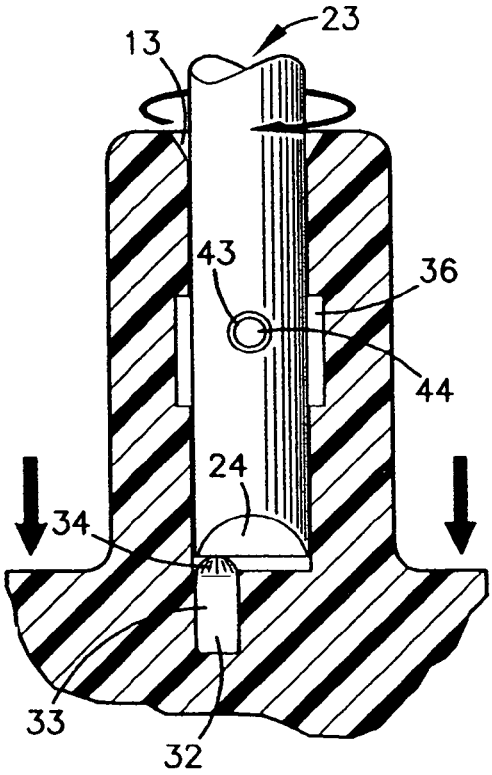
FIG. 7 is a view similar to that shown in FIG. 5, with the camshaft rotated 90 degrees and the top and riding up on cam follower.

FIGS. 5-7 depict rotation of the cam 23 through the return portion of a motion cycle in which the cam center 27 moves toward the fixed follower. In FIG. 5, the cam 23 is positioned at its lowest point in the bore 13, with the follower 32 farthest away from the cam center 27. In FIG. 6, the cam 23 has rotated clockwise from the position shown in FIG. 5 causing return of the cam center 27 toward the follower 32 and riding up of the cam 23 within the bore 13. In FIG. 7, the cam 23 has rotated clockwise 90° from the position shown in FIG. 5 to a dwell position in which the cam 23 is at rest atop the follower 32 and the cam is positioned at its highest point in the bore 13. Because the camshaft includes two cam surfaces 24, each full 360° revolution of the camshaft 23 completes two full motion cycles of the cam 23. Thus, actuation of the drill at about 1800 rpm causes oscillation of the cam 23 within the bore at about 3600 oscillations per minute.

As shown in FIG. 1, a user 61 grasps the handgrip portion 12, positions the contacting pad 11 normal to the surface of the form 3 and actuates the drill 2. This produces a uniform density filling of concrete 5 within the form 3. The axial movement of the cam 23 as it is rotated by the drill 2 is normal or perpendicular to the surface of the form 3. Advantageously, imparting this shaking movement to the foam panels 6 causes the concrete mix 5 to be agitated within the form 3. This in turn allows any bubbles present within the mix 5 to consolidate and move upwardly toward the surface of the mix 5. By commencing at the bottom area of the form 3, and working upwardly, a user 61 can urge the bubbles upwardly with the greatest efficiency. This method is particularly effective in removing bubbles in areas generally hard to reach such as corners and window and door openings, which tend to impede the flow of concrete during the pour and to collect bubbles. Those skilled in the art will appreciate that the vibrator apparatus 1 may also be used in connection with a hand drill 2 or other means for rotating the shaft 23 to compact any of a number of materials, whether or not they are contained within a form 6. For example, the apparatus may be employed to compact soil or sand.

It is to be understood that while certain forms of the present invention have been illustrated and described herein, it is not to be limited to the specific forms or arrangement of parts described and shown.

What is claimed and desired to be secured by Letters Patent is as follows:

1. A concrete vibrator apparatus for vibrating concrete mix in a form, comprising:

(a) a housing including a contacting pad and a handle fixed thereto;

(b) an axial bore extending into a portion of said housing;

(c) a shaft received within said bore;

(d) said shaft including an axially sloping cam surface at one end;

(e) a cam follower mounted in said housing and disposed within said bore to enable engagement of said cam follower by said cam surface, said follower cooperating with said cam surface to produce axial reciprocation between said shaft and said housing when said shaft is rotated and said housing is grasped by an operator; and (f) means for rotating said shaft while said pad is engaged with said form.

2. The concrete vibrator apparatus as set forth in claim 1, further including a retainer connected with said shaft for retaining said shaft within said axial bore.

3. The concrete vibrator apparatus as set forth in claim 2, wherein said retainer further includes:

(a) a hollow, generally cylindrical housing having an outwardly open end with an annular stop;

(b) a spring biased ball member; and (c) said shaft includes a radial bore for receiving said retainer.

4. The concrete vibrator apparatus as set forth in claim 2, wherein said axial bore includes a radially expanded portion for enabling free axial rotation of said retainer.

5. The concrete vibrator apparatus as set forth in claim 1, wherein said contacting pad includes a generally planar surface contacting face.

6. The concrete vibrator apparatus as set forth in claim 1 wherein said contacting pad is a cylindrical pad and said handle is a cylindrical handle.

7. The concrete vibrator apparatus as set forth in claim 1, wherein:

(a) said shaft includes an opposite end; and (b) said opposite end includes a shank for enabling connection of said vibrator apparatus with a drill chuck.

8. The concrete vibrator apparatus as set forth in claim 1, wherein said cam follower is disposed adjacent a sidewall of said axial bore.

9. The concrete vibrator apparatus as set forth in claim 1, wherein said shaft includes a pair of cam surfaces.

10. The concrete vibrator apparatus as set forth in claim 9, wherein:

(a) said cam surfaces are symmetrical; and (b) said cam surfaces each subtend a 45° angle.

11. A concrete vibrator apparatus, comprising:

(a) a housing including a contacting pad and a handle fixed thereto;

(b) an axial bore extending into a portion of said housing;

(c) a shaft received within said bore;

(d) a cam surface formed at one end of said shaft; and (e) a cam follower disposed within said bore to enable engagement by said cam surface and cooperating with said cam surface to cause reciprocation of said housing when said shaft is rotated and said housing is grasped by an operator for producing axial reciprocation between said shaft and said housing.

12. The concrete vibrator apparatus as set forth in claim 11, and including:

(a) a motor engaged with said shaft and operable to rotate said shaft.

13. The concrete vibrator apparatus as set forth in claim 11, and including:

(a) a stub shaft formed at an end of said shaft opposite said cam surface, said stub shaft enabling connection of a chuck of a hand drill to said shaft to rotate said shaft.

14. The concrete vibrator apparatus as set forth in claim 11 further including a retainer connected with said shaft for retaining said shaft within said axial bore.

15. The concrete vibrator apparatus as set forth in claim 14 wherein said axial bore includes a radially expanded portion for enabling free axial rotation of said retainer.

16. The concrete vibrator apparatus as set forth in claim 11, wherein said shaft includes a pair of cam surfaces.

17. A concrete vibrator apparatus for use with a portable drill, comprising:

(a) a housing including a contacting pad and a handle portion fixed to said contacting pad;

(b) an axial bore extending through a portion of said housing;

(c) a shaft received within said bore;

(d) said shaft including at one end a stub shaft having a reduced diameter for reception in a chuck of a drill to enable rotation of said shaft;

(e) a retainer connected with said shaft for retaining said shaft within said axial bore;

(f) said axial bore including a radially expanded portion for enabling free axial rotation of said retainer;

(g) said shaft including a pair of symmetrical cam surfaces at an opposite end of said shaft from said shank; and (h) a cam follower disposed within said bore to enable engagement by said cam surfaces and cooperating with said cam surface to cause reciprocation of said shaft within said bore for effecting axial vibration of said contacting pad normal to a contacted surface when said shaft is rotated and said housing is grasped by an operator.

* * * * *